US006318837B1

(12) United States Patent
Barinaga

(10) Patent No.: US 6,318,837 B1
(45) Date of Patent: Nov. 20, 2001

(54) BRISTLED SCRAPER CLEANING SYSTEM FOR INKJET PRINTHEADS

(75) Inventor: John A. Barinaga, Portland, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/495,011

(22) Filed: Jan. 31, 2000

(51) Int. Cl.[7] ..... B41J 2/165
(52) U.S. Cl. ..... 347/33; 347/28
(58) Field of Search ..... 347/28, 33, 22; 15/256.5; 400/701; 101/423

(56) References Cited

U.S. PATENT DOCUMENTS

| | | | |
|---|---|---|---|
| 5,614,930 | 3/1997 | Osborne et al. . | |
| 5,815,176 | 9/1998 | Rotering . | |
| 5,896,145 | 4/1999 | Osborne et al. . | |
| 5,949,448 | 9/1999 | Man et al. . | |
| 5,980,018 | 11/1999 | Taylor et al. . | |
| 6,238,035 * | 5/2001 | Barinaga | 347/33 |

FOREIGN PATENT DOCUMENTS 404278358 10/1992 (JP) .

OTHER PUBLICATIONS

Hewlett–Packard Company Patent Application filed Jul. 3, 1996, Serial No. 08/667,611, entitled "Integrated Translational Service Station for Inkjet Printheads".

Hewlett–Packard Company Patent Application filed Apr. 30, 1999, Serial No. 09/302,909, entitled "Multi–Faceted Wiper Scraper System for Inkjet Printheads".

* cited by examiner

*Primary Examiner*—Huan Tran
(74) *Attorney, Agent, or Firm*—Flory L. Martin

(57) ABSTRACT

A bristled scraper cleaning system for cleaning a scraper, which has removed ink residue from wipers following an inkjet printhead wiping routine where the residue was first removed from the printhead in an inkjet printing mechanism, has a reservoir filled with an ink solvent. A pair of bristle brushes are soaked in the ink solvent bath, then rotated to scrub ink residue from the scraper. Following this scrubbing routine, the scrapers are now ready for a fresh scraping routine, and the brushes are returned to the solvent bath to dissolve ink residue from the bristles. A method of cleaning an inkjet printhead, along with an inkjet printing mechanism having such a bristled scraper cleaning system, are also provided.

20 Claims, 13 Drawing Sheets

BRISTLED SCRAPER CLEANING SYSTEM FOR INKJET PRINTHEADS

FIELD OF THE INVENTION

The present invention relates generally to inkjet printing mechanisms, and more particularly to a bristled wiper scraper cleaning system for removing ink residue from a scraper after the scraper has removed the ink residue from a wiper following a wiping routine where the residue was first wiped from an inkjet printhead.

BACKGROUND OF THE INVENTION

Inkjet printing mechanisms use cartridges, often called "pens," which eject drops of liquid colorant, referred to generally herein as "ink," onto a page. Each pen has a printhead formed with very small nozzles through which the ink drops are fired. To print an image, the printhead is propelled back and forth across the page, ejecting drops of ink in a desired pattern as it moves. The particular ink ejection mechanism within the printhead may take on a variety of different forms known to those skilled in the art, such as those using piezo-electric or thermal printhead technology. For instance, two earlier thermal ink ejection mechanisms are shown in U.S. Pat. Nos. 5,278,584 and 4,683,481. In a thermal system, a barrier layer containing ink channels and vaporization chambers is located between a nozzle orifice plate and a substrate layer. This substrate layer typically contains linear arrays of heater elements, such as resistors, which are energized to heat ink within the vaporization chambers. Upon heating, an ink droplet is ejected from a nozzle associated with the energized resistor. By selectively energizing the resistors as the printhead moves across the page, the ink is expelled in a pattern on the print media to form a desired image (e.g., picture, chart or text).

To clean and protect the printhead, typically a "service station" mechanism is supported by the printer chassis so the printhead can be moved over the station for maintenance. For storage, or during non-printing periods, the service stations usually include a capping system which substantially seals the printhead nozzles from contaminants and drying. Some caps are also designed to facilitate priming, such as by being connected to a pumping unit that draws a vacuum on the printhead. During operation, clogs in the printhead are periodically cleared by firing a number of drops of ink through each of the nozzles in a process known as "spitting," with the waste ink being collected in a "spittoon" reservoir portion of the service station. After spitting, uncapping, or occasionally during printing, most service stations have an elastomeric wiper that wipes the printhead surface to remove ink residue, as well as any paper dust or other debris that has collected on the printhead. The wiping action is usually achieved through relative motion of the printhead and wiper, for instance by moving the printhead across the wiper, by moving the wiper across the printhead, or by moving both the printhead and the wiper.

To improve the clarity and contrast of the printed image, recent research has focused on improving the ink itself. To provide quicker, more waterfast printing with darker blacks and more vivid colors, pigment-based inks have been developed. These pigment-based inks have a higher solid content than the earlier dye-based inks, which results in a higher optical density for the new inks. Both types of ink dry quickly, which allows inkjet printing mechanisms to form high quality images on readily available and economical plain paper, as well as on recently developed specialty coated papers, transparencies, fabric and other media.

As the inkjet industry investigates new printhead designs, the tendency is toward using permanent or semi-permanent printheads in what is known in the industry as an "off-axis" printer. In an off-axis system, the printheads carry only a small ink supply across the printzone, with this supply being replenished through tubing that delivers ink from an "off-axis" stationary reservoir placed at a remote stationary location within the printer. Since these permanent or semi-permanent printheads carry only a small ink supply, they may be physically more narrow than their predecessors, the replaceable cartridges. Narrower printheads lead to a narrower printing mechanism, which has a smaller "footprint," so less desktop space is needed to house the printing mechanism during use. Narrower printheads are usually smaller and lighter, so smaller carriages, bearings, and drive motors may be used, leading to a more economical printing unit for consumers.

There are a variety of advantages associated with these off-axis printing systems, but the permanent or semi-permanent nature of the printheads requires special considerations for servicing, particularly when wiping ink residue from the printheads. This wiping must be accomplished without any appreciable wear that could decrease printhead life, and without using excessive forces that could otherwise un-seat the pen from the carriage alignment datums.

In the past, the printhead wipers have been a single or dual wiper blade made of an elastomeric material. Typically, the printhead is translated across the wiper in a direction parallel to the scan axis of the printhead. In one printer, the wipers were rotated about an axis perpendicular to the printhead scan axis to wipe. Today, most inkjet pens have nozzles aligned in two linear arrays which run perpendicular to the scanning axis. Using these earlier wiping methods, first one row of nozzles was wiped and then the other row of nozzles was wiped. While these earlier wiping methods proved satisfactory for the traditional dye based inks, unfortunately, they were unacceptable for the newer fast drying pigment inks.

One suitable service station design for pigment-based inks was a rotary device first sold in the DeskJet® 850C and 855C color inkjet printers, and later in the DeskJet® 820C and 870C color inkjet printers by Hewlett-Packard Company of Palo Alto, Calif., the present assignee. This rotary device mounted the wipers, primers and caps on a motor-operated tumbler. These pens were wiped using an orthogonal wiping technique, where the wipers ran along the length of the linear nozzle arrays, wicking ink along the arrays from one nozzle to the next to serve as a solvent to break down ink residue accumulated on the nozzle plate. A camming device moved a horizontal arm carrying a wiper scraper into position to clean ink residue from the wipers as they rotated past. The scraper arm had capillary channels formed along the under surface from the scraper tip to an absorbent blotter pad.

A translational or sliding orthogonal wiping system was first sold by the Hewlett-Packard Company in the DeskJet® 720C and 722C color inkjet printers. The wipers were slid under a stationary vertical, rigid plastic wiper bar to clean off any clinging ink residue. This wiper bar had an inverted T-shaped head which assisted in scraping the wipers clean. Another wiper system using rotational and vertical motion was first sold by the Hewlett-Packard Company in the DeskJet®2000C Professional Series color inkjet printer. This was one of the first service station systems in a Hewlett-Packard Company inkjet printer to use an ink solvent, specifically polyethylene glycol ("PEG"), to clean and lubricate the printheads. This service station required two costly motors to operate the service station for moving the service station servicing components both vertically and rotationally. Another wiper system first sold by the Hewlett-Packard Company as the HP PhotoSmart color printer wipers with vertical capillary channels along each side surface of the wipers to allow the liquid ink residue to drain away from the wiper tip under the force of gravity and capillary forces.

In past service stations, accumulation of ink residue and other debris on the wiper scraper has limited the effective life during which the wiper scraper effectively cleans the wipers. Thus, to extend service station life and the overall printer life, maintaining wiper cleanliness is a critical limiting factor. Dirty wipers not only fail to adequately clean the printheads leading to print quality defects, but they also contaminate the ink solvent and plug the solvent applicator pores, leading to poor pen health.

Thus, while a variety of different wiper scraper systems have been proposed and implemented, a need still remains for a service station having a wiper scraper system which meets or exceeds the operational performance of its predecessors in maintaining printhead health, and yet which uses more economical components.

SUMMARY OF THE INVENTION

A wiper scraper cleaning system is provided for cleaning ink residue from a scraper which has removed the ink residue from a wiper following an inkjet printhead wiping routine where the wiper wiped the ink residue from the printhead in an inkjet printing mechanism. The cleaning system includes a frame and a moveable platform supported by the frame to move the wiper through a scraping stroke and a wiping stroke for cleaning ink residue from the printhead. A scraper is supported by the frame to scrape ink residue from the wiper during the scraping stroke. The cleaning system also has a scraper cleaner supported by the frame for movement from a rest position through a scraper cleaning stroke to remove ink residue from the scraper.

According to another aspect of the present invention, a method is provided for cleaning ink residue from an inkjet printhead in an inkjet printing mechanism. The method includes the step of providing a wiper, a scraper, and a scraper cleaner. In a wiping step, ink residue is wiped from the printhead using the wiper. In a scraping step, ink residue is scraped from the wiper. Following the scraping step, the method further includes the step of cleaning the scraper with the scraper cleaner.

According to a further aspect of the present invention, an inkjet printing mechanism may be provided with a wiper scraper cleaning system as described above.

An overall goal of the present invention is to provide an inkjet printing mechanism which prints sharp vivid images over the life of the printhead and the printing mechanism, particularly when using fast drying pigment or dye-based inks, and preferably when dispensed from an off-axis system.

Another goal of the present invention is to provide a wiping system for cleaning printheads in an inkjet printing mechanism to prolong printhead life.

Still another goal of the present invention is to provide a printhead wiping system for cleaning printheads in an inkjet printing mechanism, with the system having fewer parts that are easier to manufacture than earlier systems, and which thus provides consumers with a reliable, economical inkjet printing unit.

BRIEF DESCRIPTION OF THE DRAWINGS

FIG. 4–7 are enlarged, side elevational views of the service station of FIG. 1 showing various stages of a pallet flip-down sequence, with:

FIG. 4 showing a first stage;

FIG. 5 showing a second stage;

FIG. 6 showing a third stage; and

FIG. 7 showing a fourth stage.

FIG. 9–11 are enlarged, side elevational views of the service station of FIG. 1 showing various beginning stages of a pallet flip-up sequence, with:

FIG. 9 showing a first stage;

FIG. 10 showing a second stage;

FIG. 11 showing a third stage;

FIG. 14–15 are enlarged, front elevational views of the service station of FIG. 1 showing the operation of a detent member which holds the pallet either upright for wiping or inverted for scraping, with:

FIG. 14 showing the pallet upright for wiping; and

FIG. 15 showing the pallet inverted for scraping.

DETAILED DESCRIPTION OF A PREFERRED EMBODIMENT

Figure 1:
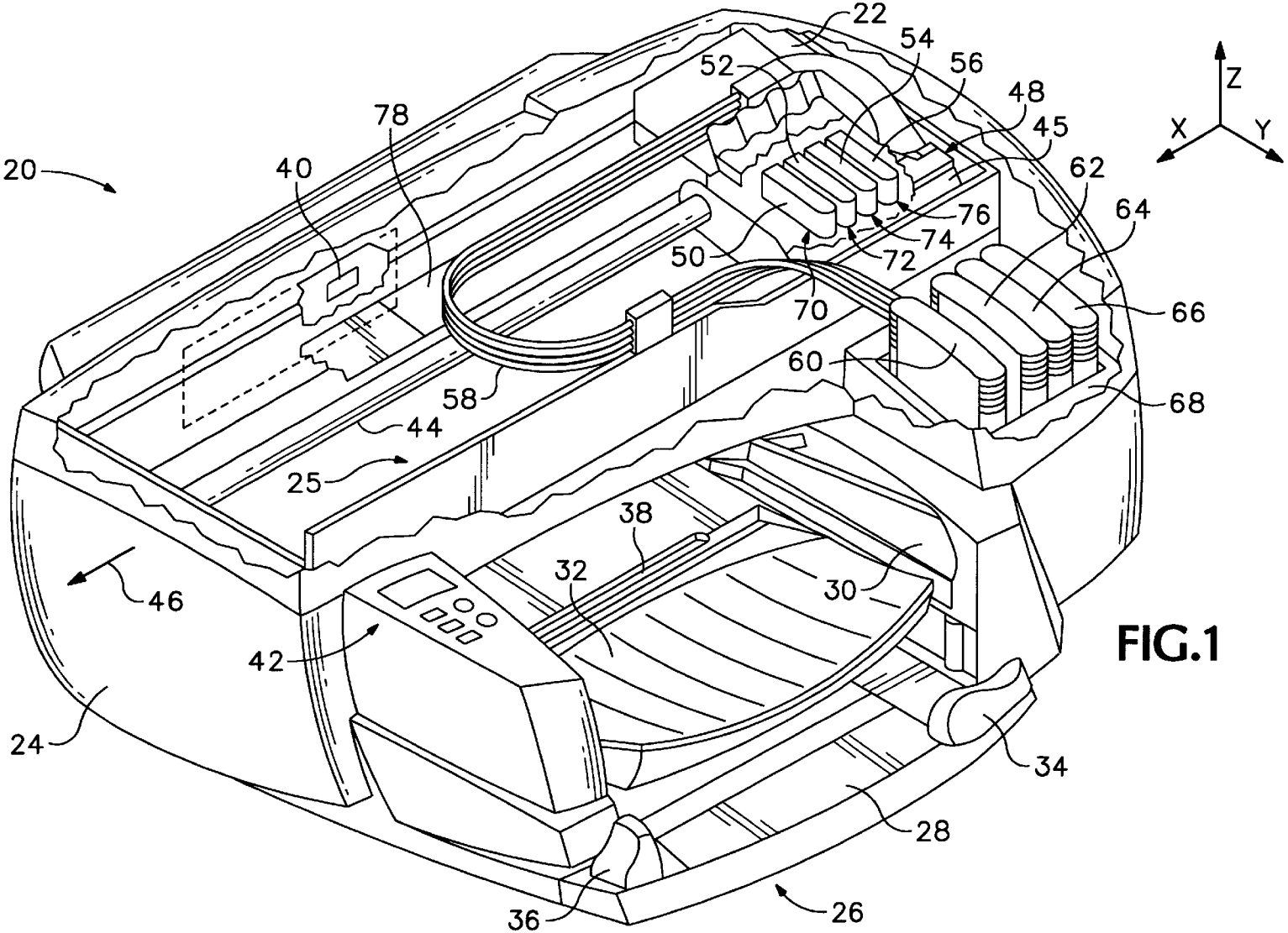
FIG. 1 is a perspective view of one form of an inkjet printing mechanism, here, an inkjet printer, including a printhead service station having one form of a flipping wiper scraper system of the present invention for removing ink residue from a wiper after cleaning the residue from an inkjet printhead.

FIG. 1 illustrates an embodiment of an inkjet printing mechanism, here shown as an "off-axis" inkjet printer 20, constructed in accordance with the present invention, which may be used for printing for business reports, correspondence, desktop publishing, and the like, in an industrial, office, home or other environment. A variety of inkjet printing mechanisms are commercially available. For instance, some of the printing mechanisms that may embody the present invention include plotters, portable printing units, copiers, cameras, video printers, and facsimile machines, to name a few, as well as various combination devices, such as a combination facsimile/printer. For convenience the concepts of the present invention are illustrated in the environment of an inkjet printer 20.

While it is apparent that the printer components may vary from model to model, the typical inkjet printer 20 includes a frame or chassis 22 surrounded by a housing, casing or enclosure 24, typically of a plastic material. Sheets of print media are fed through a printzone 25 by a media handling system 26. The print media may be any type of suitable sheet material, such as paper, card-stock, transparencies, photographic paper, fabric, mylar, and the like, but for convenience, the illustrated embodiment is described using paper as the print medium. The media handling system 26 has a feed tray 28 for storing sheets of paper before printing. A series of conventional paper drive rollers driven by a DC (direct current) motor and drive gear assembly (not shown), may be used to move the print media from the input supply tray 28, through the printzone 25, and after printing, onto a pair of extended output drying wing members 30, shown in a retracted or rest position in FIG. 1. The wings 30 momentarily hold a newly printed sheet above any previously printed sheets still drying in an output tray portion 32, then the wings 30 retract to the sides to drop the newly printed sheet into the output tray 32. The media handling system 26 may include a series of adjustment mechanisms for accommodating different sizes of print media, including letter, legal, A-4, envelopes, etc., such as a sliding length adjustment lever 34, a sliding width adjustment lever 36, and an envelope feed port 38.

The printer 20 also has a printer controller, illustrated schematically as a microprocessor 40, that receives instructions from a host device, typically a computer, such as a personal computer (not shown). The printer controller 40 may also operate in response to user inputs provided through a key pad 42 located on the exterior of the casing 24. A monitor coupled to the computer host may be used to display visual information to an operator, such as the printer status or a particular program being run on the host computer. Personal computers, their input devices, such as a keyboard and/or a mouse device, and monitors are all well known to those skilled in the art.

A carriage guide rod 44 is supported by the chassis 22 to slideably support an off-axis inkjet pen carriage system 45 for travel back and forth across the printzone 25 along a scanning axis 46. The carriage 45 is also propelled along guide rod 44 into a servicing region, as indicated generally by arrow 48, located within the interior of the housing 24. A conventional carriage drive gear and DC (direct current) motor assembly may be coupled to drive an endless belt (not shown), which may be secured in a conventional manner to the carriage 45, with the DC motor operating in response to control signals received from the controller 40 to incrementally advance the carriage 45 along guide rod 44 in response to rotation of the DC motor. To provide carriage positional feedback information to printer controller 40, a conventional encoder strip may extend along the length of the printzone 25 and over the service station area 48, with a conventional optical encoder reader being mounted on the back surface of printhead carriage 45 to read positional information provided by the encoder strip. The manner of providing positional feedback information via an encoder strip reader may be accomplished in a variety of different ways known to those skilled in the art.

In the printzone 25, a media sheet receives ink from an inkjet cartridge, such as a black ink cartridge 50 and three monochrome color ink cartridges 52, 54 and 56, shown in FIG. 1. The cartridges 50–56 are also often called "pens" by those in the art. The black ink pen 50 is illustrated herein as containing a pigment-based ink. While the illustrated color pens 52–56 may contain pigment-based inks, for the purposes of illustration, color pens 52–56 are described as each containing a dye-based ink of the colors cyan, magenta and yellow, respectively. It is apparent that other types of inks may also be used in pens 50–56, such as paraffin-based inks, as well as hybrid or composite inks having both dye and pigment characteristics.

The illustrated pens 50–56 each include small reservoirs for storing a supply of ink in what is known as an "off-axis" ink delivery system, which is in contrast to a replaceable cartridge system where each pen has a reservoir that carries the entire ink supply as the printhead reciprocates over the printzone 25 along the scan axis 46. Hence, the replaceable cartridge system may be considered as an "on-axis" system, whereas systems which store the main ink supply at a stationary location remote from the printzone scanning axis are called "off-axis" systems. In the illustrated off-axis printer 20, ink of each color for each printhead is delivered via a conduit or tubing system 58 from a group of main stationary reservoirs 60, 62, 64 and 66 to the on-board reservoirs of pens 50, 52, 54 and 56, respectively. The stationary or main reservoirs 60–66 are replaceable ink supplies stored in a receptacle 68 supported by the printer chassis 22. Each of pens 50, 52, 54 and 56 have printheads 70, 72, 74 and 76, respectively, which selectively eject ink to form an image on a sheet of media in the printzone 25. The concepts disclosed herein for cleaning the printheads 70–76 apply equally to the totally replaceable inkjet cartridges, as well as to the illustrated off-axis semi-permanent or permanent printheads, although the greatest benefits of the illustrated system may be realized in an off-axis system where extended printhead life is particularly desirable.

The printheads 70, 72, 74 and 76 each have an orifice plate with a plurality of nozzles formed therethrough in a manner well known to those skilled in the art. The nozzles of each printhead 70–76 are typically formed in at least one, but typically two linear arrays along the orifice plate. Thus, the term "linear" as used herein may be interpreted as "nearly linear" or substantially linear, and may include nozzle arrangements slightly offset from one another, for example, in a zigzag arrangement. Each linear array is typically aligned in a longitudinal direction perpendicular to the scanning axis 46, with the length of each array determining the maximum image swath for a single pass of the printhead. The illustrated printheads 70–76 are thermal inkjet printheads, although other types of printheads may be used, such as piezoelectric printheads. The thermal printheads 70–76 typically include a plurality of resistors which are associated with the nozzles. Upon energizing a selected resistor, a bubble of gas is formed which ejects a droplet of ink from the nozzle and onto a sheet of paper in the printzone 25 under the nozzle. The printhead resistors are selectively energized in response to firing command control signals delivered by a multi-conductor strip 78 from the controller 40 to the printhead carriage 45.

Figure 2:
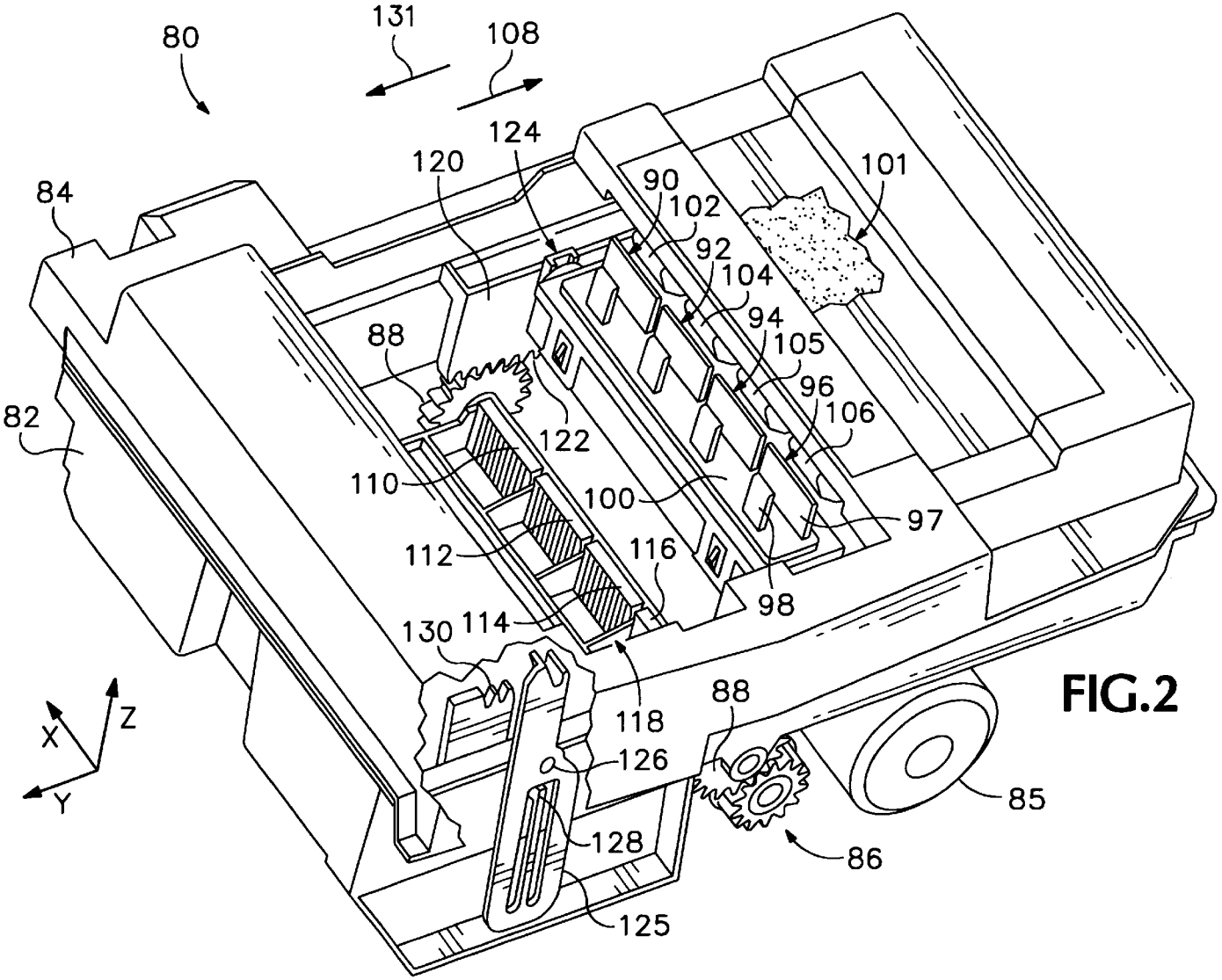
FIG. 2 is a perspective view of the service station of FIG. 1.

FIG. 2 shows one form of a flipping wiper scraper service station 80, constructed in accordance with the present invention. The service station 80 has a frame which includes a lower deck 82 and an upper deck 84, which may be joined together by screws, a snap fit, or other fastener devices. The frame lower deck 82 supports a service station motor 85, a gear assembly 86, and a spindle gear 88. The motor 85 drives the gear assembly 86, which in turn drives the spindle gear 88 to move various printhead servicing components into position to service each of the printheads 70–76 when in the servicing region 48. For example, four wiper assemblies 90, 92, 94 and 96 are moved through the action of motor 85, gear assembly 86 and spindle gear 88, to wipe ink residue from the printheads 70, 72, 74 and 76, respectively. Each of the wiper assemblies 90–96 has a large wiper 97, which wipes across the entire orifice plate, and a dedicated nozzle wiper 98 which concentrates on the central nozzle region of the printhead. Each of the wiper assemblies 90–96 are supported by a flipping wiper sled 100, which operates as described further below.

Other servicing components may be also supported by the service station frame 82, 84. For instance, to aid in removing ink residue from printheads 70–76, an ink solvent is used, such as a hygroscopic material, for instance polyethylene glycol ("PEG"), lipponic-ethylene glycol ("LEG"), diethylene glycol ("DEG"), glycerin or other materials known to those skilled in the art as having similar properties. These hygroscopic materials are liquid or gelatinous compounds that will not readily dry out during extended periods of time because they have a large molecular size which leads to a low, almost zero, vapor pressure. This ink solvent is stored in an ink solvent reservoir 101 which is supported along an interior surface of the frame upper deck 84. For the purposes of illustration, the preferred ink solvent used by the service station 80 is PEG, and the solvent reservoir 101 is divided into four separate reservoirs, one for each color (black, cyan, yellow and magenta) to prevent cross contamination of the colors at the reservoir 101. The ink solvent reservoir 101 is fluidically coupled to four solvent applicator pads 102, 104, 105 and 106, which apply ink solvent to the large wiper blades 97 of the respective wiper assemblies 90, 92, 94 and 96, respectively, when the sled 100 is moved in a rearward direction, as indicated by arrow 108.

A series of wiper scrapers, including scrapers 110, 112, 114 and 116 are supported by the frame lower deck 82 to remove ink residue from the wiper assemblies 90, 92, 94 and 96, respectively, after they have removed the residue from the printheads 70–76. Preferably, the wiper scrapers 110–116 are constructed as an integral scraper assembly 118, which is formed as a unitary member for ease of assembly and attachment to the frame lower deck 82. The details of construction of the scraper assembly will be described further below, along with several alternate embodiments for constructing the scraper assembly 118 (see FIGS. 16–19).

Another main component of the service station 80 is a moveable platform or pallet 120, which has a rack gear 122 that is engaged by the spindle gear 88 to be driven by motor 85 and gear assembly 86 in the positive and negative Y-axis directions. The wiper sled 100 is pivotally mounted to the pallet 120, for instance using shaft 124 which is seated in bushings formed in the pallet 120 (see FIGS. 14 and 15). To transition the wipers 90–96 from an inverted position, where they may be cleaned by the scrapers 110–116, to their upright wiping position shown in FIG. 2, the service station 80 includes a trip lever 125 which is pivotally mounted at post 126 to the exterior of the frame lower deck 82. To limit rotation of the trip lever 125 around post 126, the lever 125 includes a stop member 128, which engages a pair of stop features (described further below with respect to FIG. 9) molded into the lower deck 82. By forming the stop member 128 as a cut-out portion of the trip lever 125, the stop 128 has a spring action, which serves to damp operation of the trip lever 125 and quiet operation of the service station 80, as well as returning the trip lever 25 to a neutral position. The service station 80 also has a tumbling or flip gear 130 formed as a stationary rack gear supported by the lower deck 82.

Figure 3:
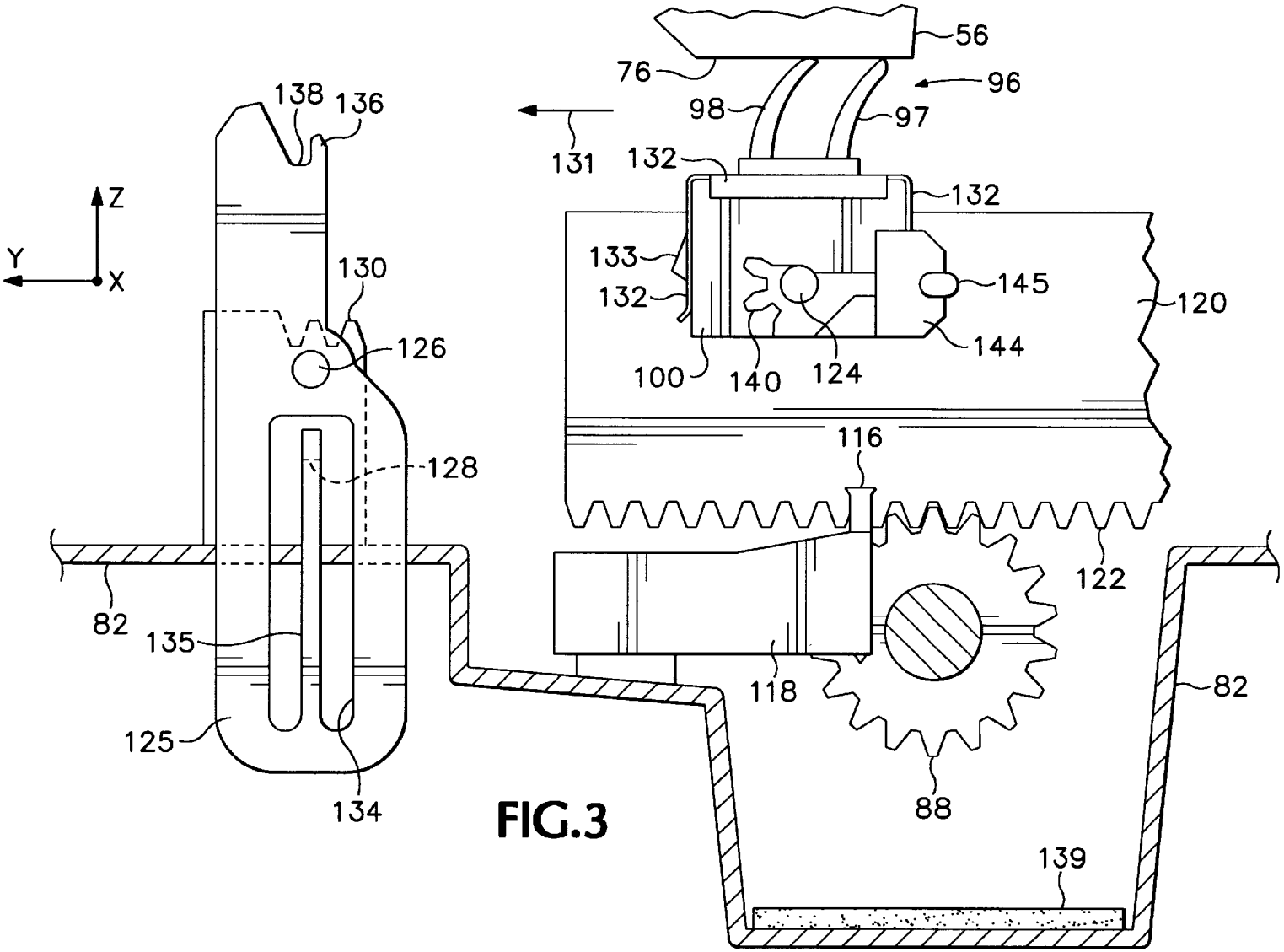
FIG. 3 is an enlarged, side elevational view of the service station of FIG. 1 shown with the wipers upright while wiping ink residue from an inkjet printhead.

FIG. 3 shows the color wiper assembly 96 wiping printhead 76 of pen 56. Prior to beginning the wiping cycle, preferably ink solvent from reservoir 101 is applied to the wiper assemblies 90–96 through rearward movement 108 of the pallet 120 which causes the wiper blades 97 to contact the solvent applicator pads 102–106, respectively. During the wiping stroke, the wiper assembly 96 is in an upright position with the spindle gear 88 engaging the pallet rack gear 122 to move the pallet bi-directionally, for instance in the rearward direction 108 and in a forward direction, as indicated by arrow 131.

FIG. 3 also shows more detail about the mounting of the wiper blades 97, 98 to the sled 100. Preferably, the wiper blades 97, 98 of assemblies 92–96 are onsert molded onto a stainless steel wiper mount 132, which is preferably snap fit over tabs 133 projecting from the sled 100. Similar mounting techniques for wiper blades have been used on earlier products, such as in the Hewlett-Packard Company's DeskJet® 720 and 722 color inkjet printers. FIG. 3 also shows other features of the trip lever 125, including an inverted U-shaped slot 134, which defines a spring arm 135 from which the stop 128 projects. The trip lever 125 also includes a thumb member 136, and a notch 138 which are used in the flipping-up operation of sled 100, to move the blades from an inverted position for scraping the wipers to the upright position for wiping, as described further below.

A couple of other features of the service station 80 are also shown in FIG. 3, including an absorbent liner 139 which rests along the bottom of the interior of the frame lower deck 82. The liner 139 may be of a cellulosic material or other equivalent materials known to those skilled in the art. FIG. 3 shows the sled 100 as having a sled flipping gear 140 which is centered around the sled pivot shaft 124. The flipping gear 140 engages the stationary flip gear 130 as described further below to rotate the sled 100 from the upright wiping position of FIG. 3, to an inverted scraping position. The sled 100 also includes a cantilevered support member 144 which extends outwardly beyond the pivot 124, that is, in the view of FIG. 3 out of the plane of the drawing sheet in the negative X-axis direction. Projecting further outwardly in the negative X-axis direction from the cantilevered support 144 is an oblong flip arm 145, which engages notch 138 of the trip lever during the flipping-up sequence as described further below. As described further below, the flip arm 145 also serves as a backup cam surface which is used to assure the wiper blades return to the upright position if other portions of the assembly fail to function as expected.

Figure 4:
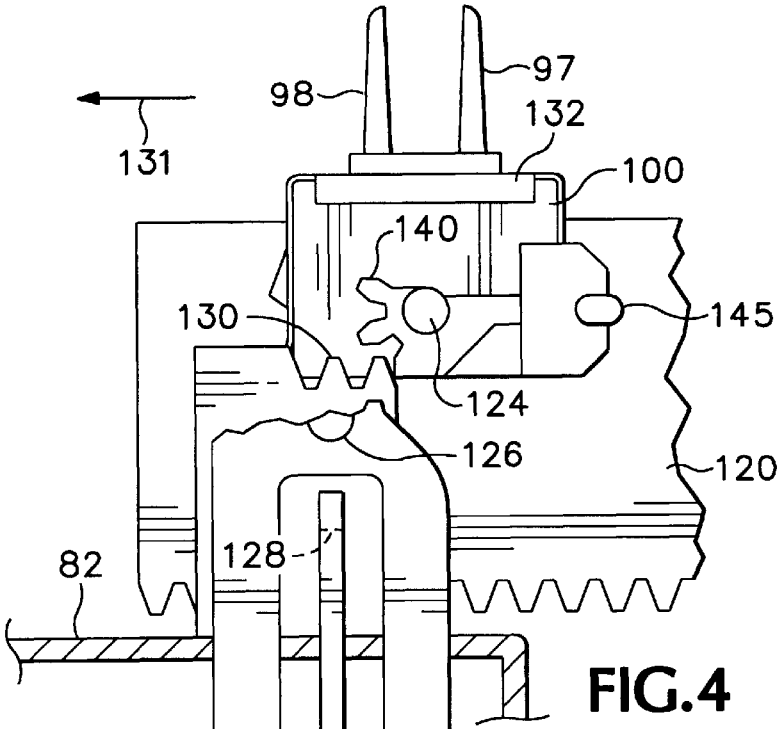
Figure 5:
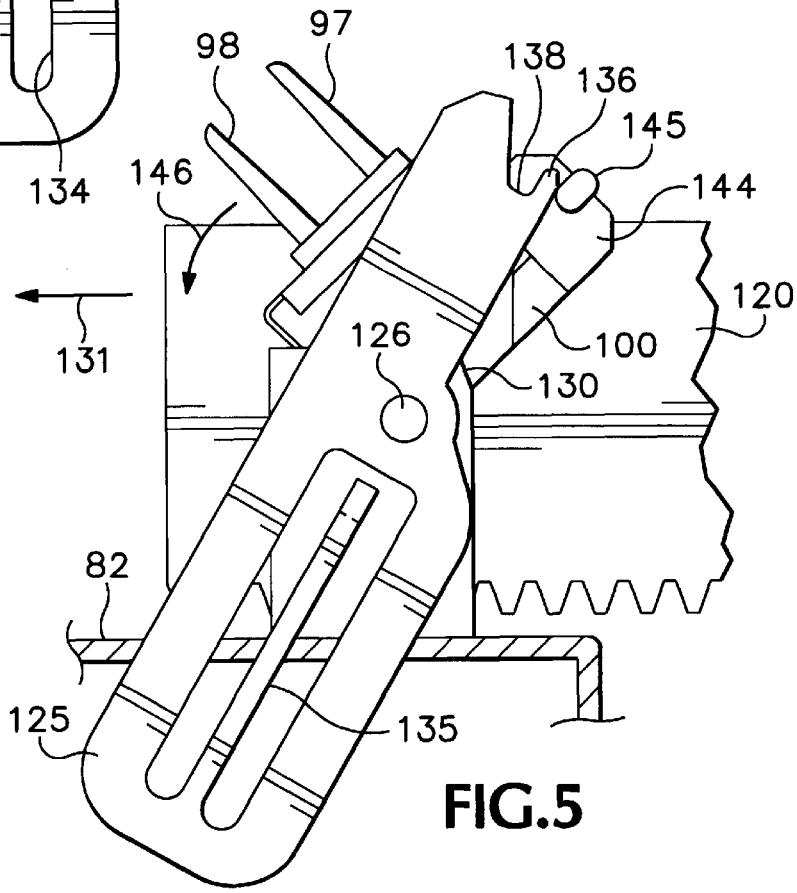

FIGS. 4–7 illustrate the flipping down sequence, where the wipers 90–96 move from the upright wiping position to the inverted scraping position. In FIG. 4, the pallet 120 has begun moving in the forward direction of arrow 131. FIG. 4 shows the fixed tumbling gear teeth 130 just before they are engaged with the sled flipping gear teeth 140. FIG. 5 shows the beginning of the flipping action, where gear teeth 130 and 140 are fully engaged, although this engagement is hidden by a portion of the trip lever 125 in FIG. 5. This engagement of teeth 130 and 140 has been caused by continued motion of the pallet 120 in the forward direction 131, which has caused the sled 100 to rotate in the direction of arrow 146. Also during this motion, the outer surface of the trip lever thumb 136 has been engaged by the flip arm 145, causing the trip lever 125 to rotate around pivot post 126 in the direction of arrow 146. This rotation of the trip lever 125 is used to place the lever in the proper position for use during the flip-up sequence.

Figure 6:
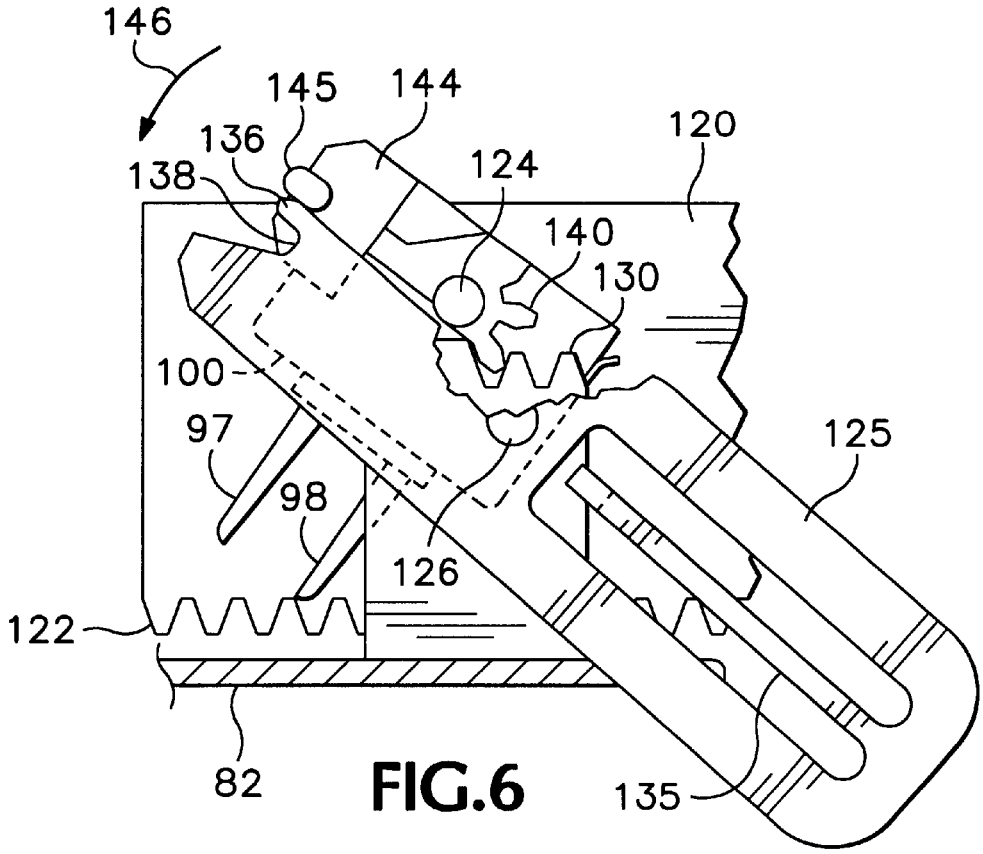
Figure 7:
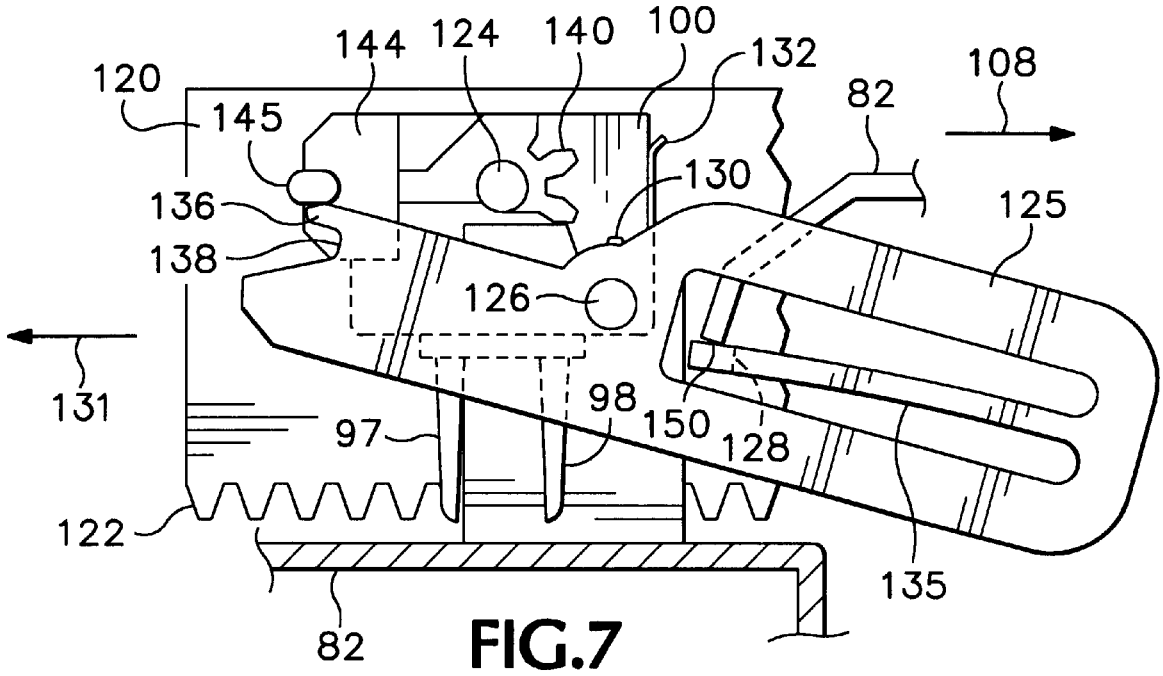

FIG. 6 shows further rotation of the sled 100 and the trip lever 125, both in the direction of arrow 146. In FIG. 6, we see the flipping gear teeth 130 and 140 in a latter stage of their engagement. FIG. 7 shows the completion of the flipping down sequence, where the wiper blades 97, 98 are now in an inverted position. The gear teeth 130, 140 are now completely disengaged and the flip arm rests on the outer surface of the trip lever thumb 136. FIG. 7 shows the trip lever stop 128 contacting a bumper stop member 150 which extends from the frame lower deck 82. The spring nature of the stop arm 135 serves to actively push the trip lever thumb 136 into engagement with the flip arm 145. Note, given the spring nature of the stop arm 135, any further motion of the pallet 120 in the direction of arrow 131 beyond the position of FIG. 7 causes the flip arm 145 to fall into notch 138, a step which is reserved for the flipping up sequence described further below. Thus, from the position of FIG. 7 the pallet 120 begins traversing in the rearward direction of arrow 108 to begin the wiper scraping sequence.

Figure 8:
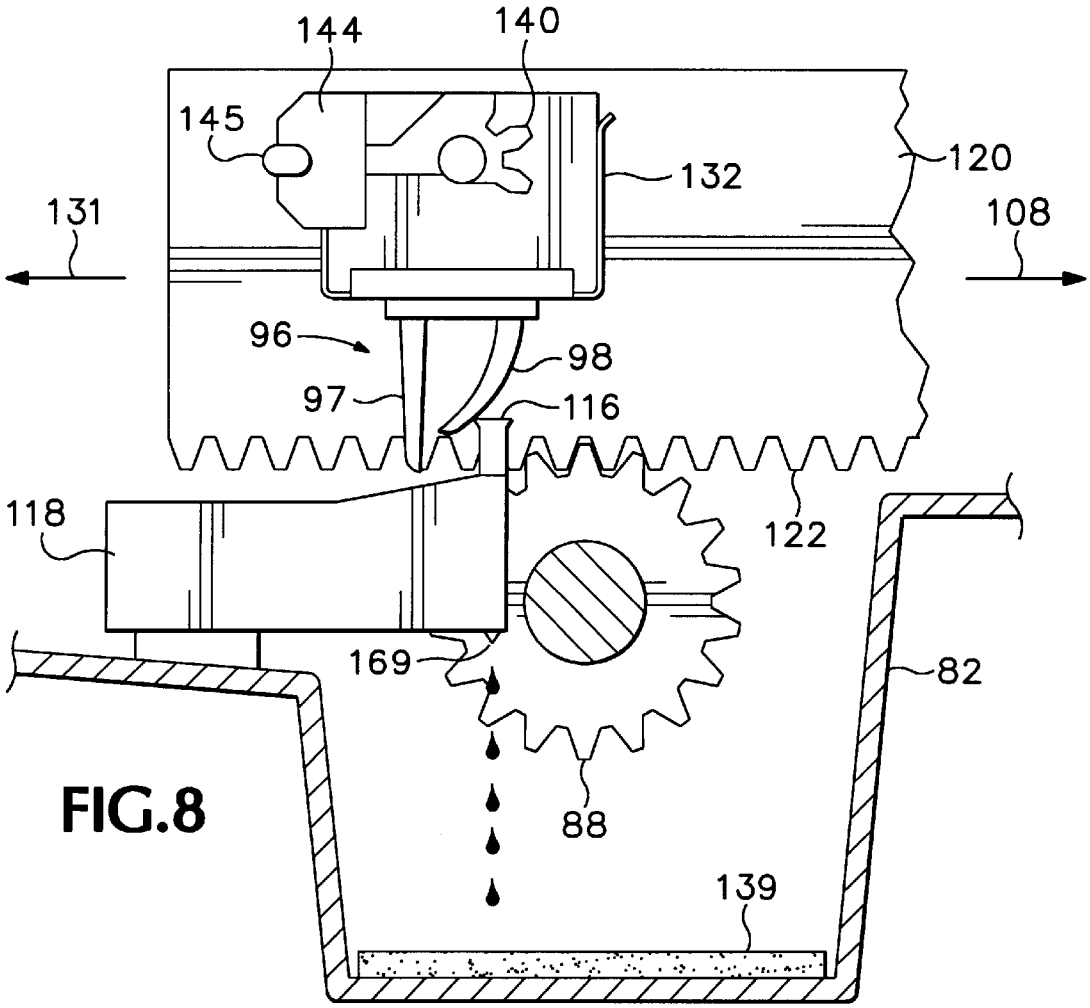
FIG. 8 is an enlarged, side elevational view of the service station of FIG. 1 showing the pallet inverted during a wiper scraping routine.

FIG. 8 shows the wiper scraping sequence, where the blades 97, 98 of the wiper assemblies 90–96 have ink residue scraped from their surfaces through contact with the scraper bars 110–116. From the position of FIG. 8, the pallet 120 continues to traverse in the rearward direction 108 until wiper blades 97 and 98 have had their rearward facing surfaces scraped by their associated scraper bars, such as scraper bar 116 which cleans wiper assembly 96. After the last wiper blade 97 has passed over the scraper bars, the pallet 120 stops and reverses direction to move in the forward direction 131 for a second phase of the scraping stroke. The frontward facing surfaces of wiper blades 97, 98 are scraped clean of ink residue by the scraper bar 116. In some scraping sequences, it may be desirable to repeat this forward and rearward motion several times, although in the preferred embodiment a single bi-directional scraping scheme is preferred.

Figure 9:
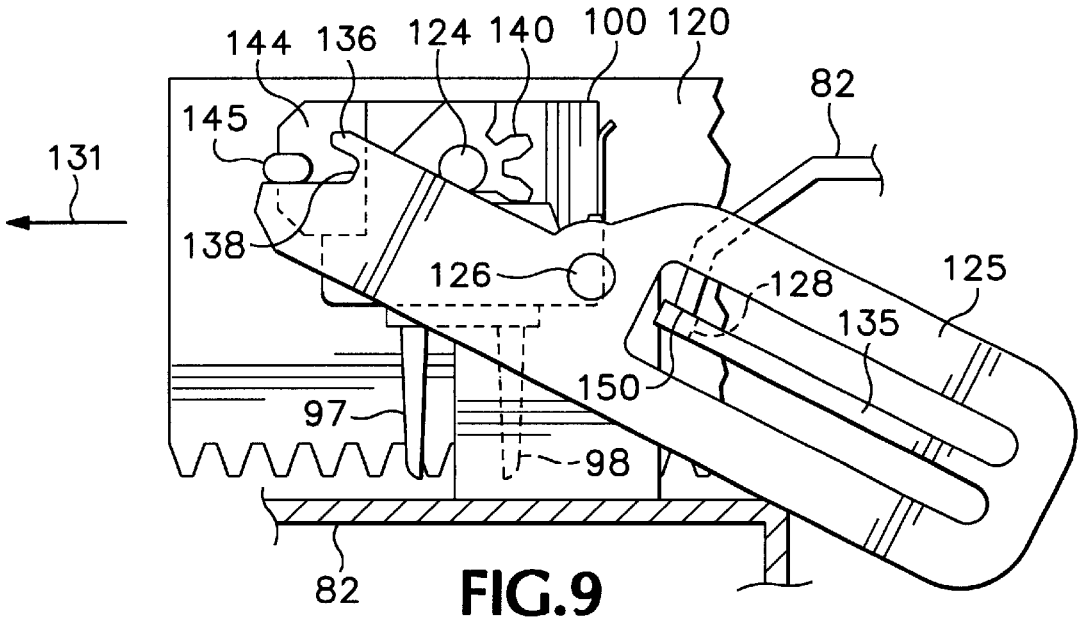
Figure 10:
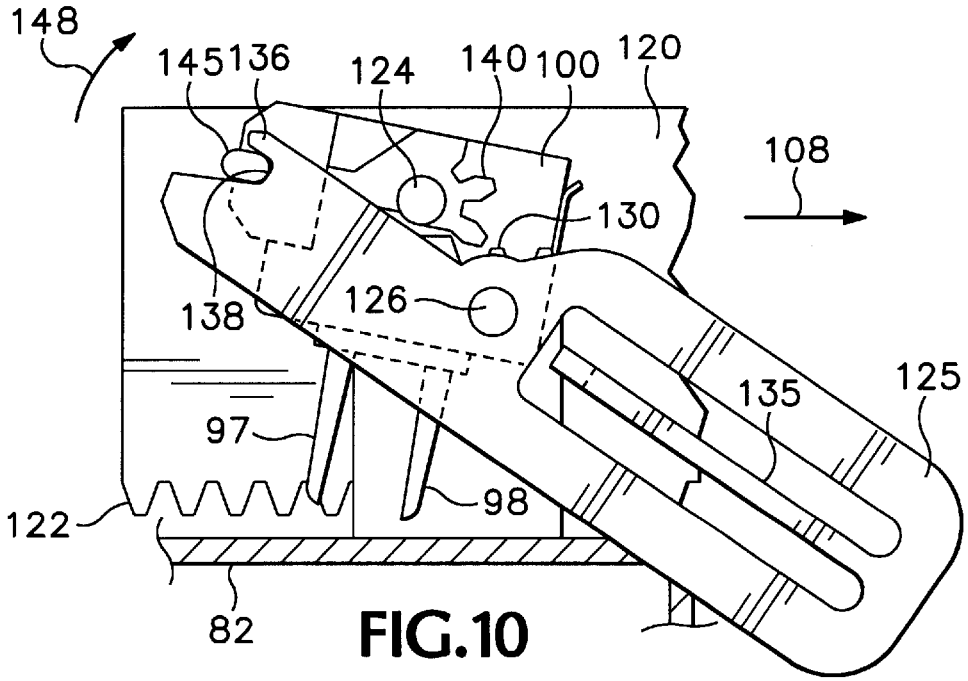
Figure 11:
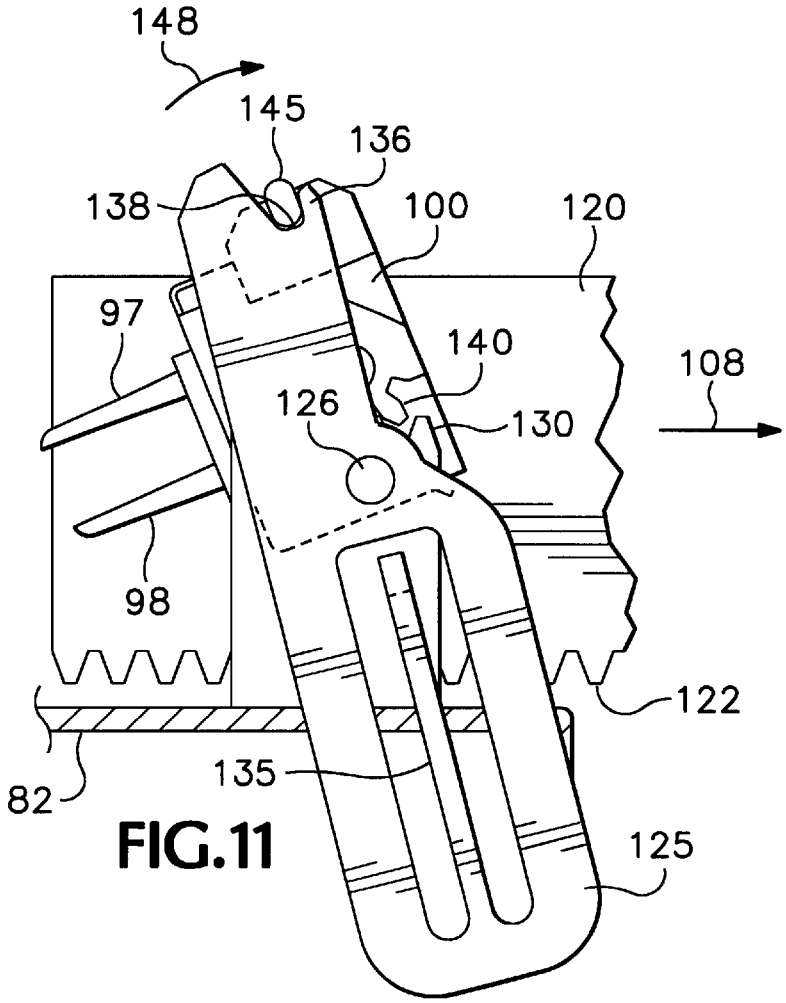

FIGS. 9–11 show the flipping up sequence which follows the scraping operation of FIG. 8. In comparing FIG. 9 with FIG. 7, it is seen that the pallet 120 in FIG. 9 has moved further in the forward direction 131 than in FIG. 7. This extreme forward motion of the pallet 120 has caused the flip arm 145 to move beyond the trip lever thumb 136. Under the biasing force supplied by the trip lever spring arm 135, and the engagement of the stop 128 with the frame bumper 150 (FIG. 7), the flip arm 145 has dropped down into a position ready to engage trip the lever notch 138, as shown in FIG. 10.

In FIG. 10, the pallet 120 has begun to move in the rearward direction 108, causing the sled 100 to begin pivoting around the shaft 124 in the direction of arrow 148. Through engagement of the flip arm 145 and the trip lever notch 138, this rearward motion of pallet 120 causes the trip lever 125 to pivot around post 126 also in the direction of arrow 148. Engagement of the flip arm 145 and the trip lever notch 138 forces the sled 100 to rotate into the upright position as the pallet 120 continues moving in the rearward direction 108, as shown in FIG. 11. This rotation of the sled 100 is also assisted by engagement of the flip gears 130 and 140.

Figure 12:
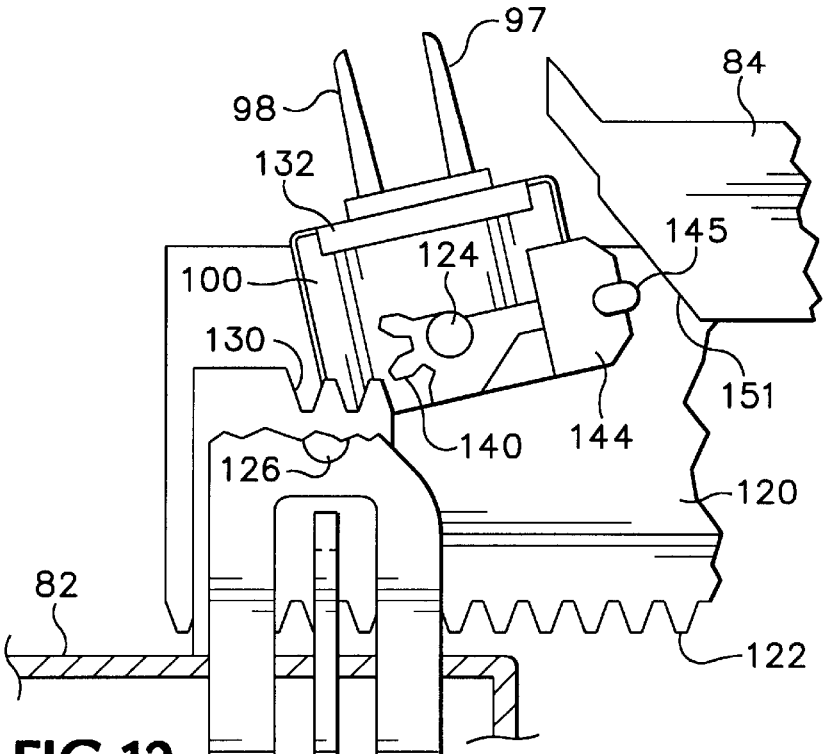
FIG. 12 showing a fourth stage.
Figure 13:
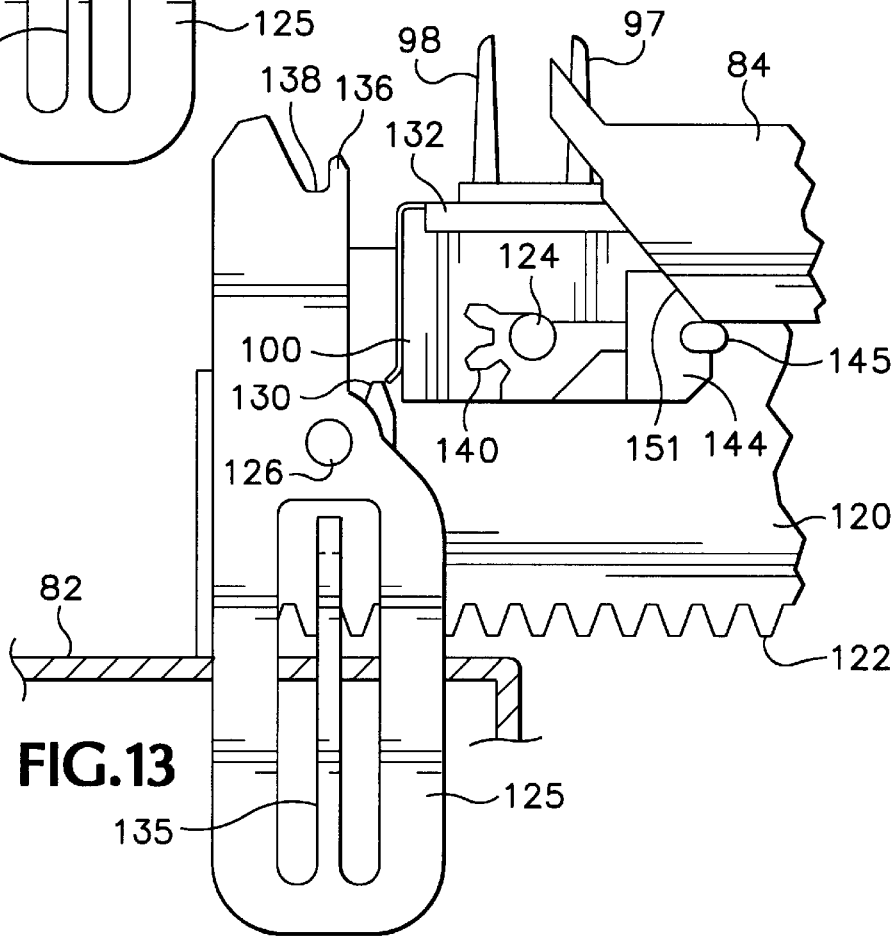
FIG. 13 showing a fifth stage.

FIG. 12 shows the sled 100 nearing the completion of its rotation in the direction of arrow 148. In FIG. 12, we see the flipping gears 130 and 140 are now disengaged. In prototype units, it was found that occasionally during this flipping up sequence, the sled 100 did not return to a fully upright position, remaining at a slight angle, as shown in FIG. 12. To accommodate these occasional instances where the sled 100 did not return to a full upright position, the backup cam surface of the flip arm 145 was formed to engage a cam surface 151 formed on a portion of the frame lower deck 82 during wiping and scraping. Following engagement of cam surfaces 145 and 151, FIG. 13 shows the sled 100 now in a fully upright position ready to perform a wiping stroke. To assist in aligning the sled 100 and pallet 120, as well as preventing the sled from rotating under torsional forces generated during the wiping and scraping operations, the flip arm 145 may ride along in a groove or slot (not shown) defined by the interior surface of the frame upper deck 84 and/or the frame lower deck 82. In FIG. 13, the trip lever 125 has been left in a roughly upright position, awaiting contact by the flip arm 145 for presetting, as described above with respect to FIGS. 5–7.

Figure 14:
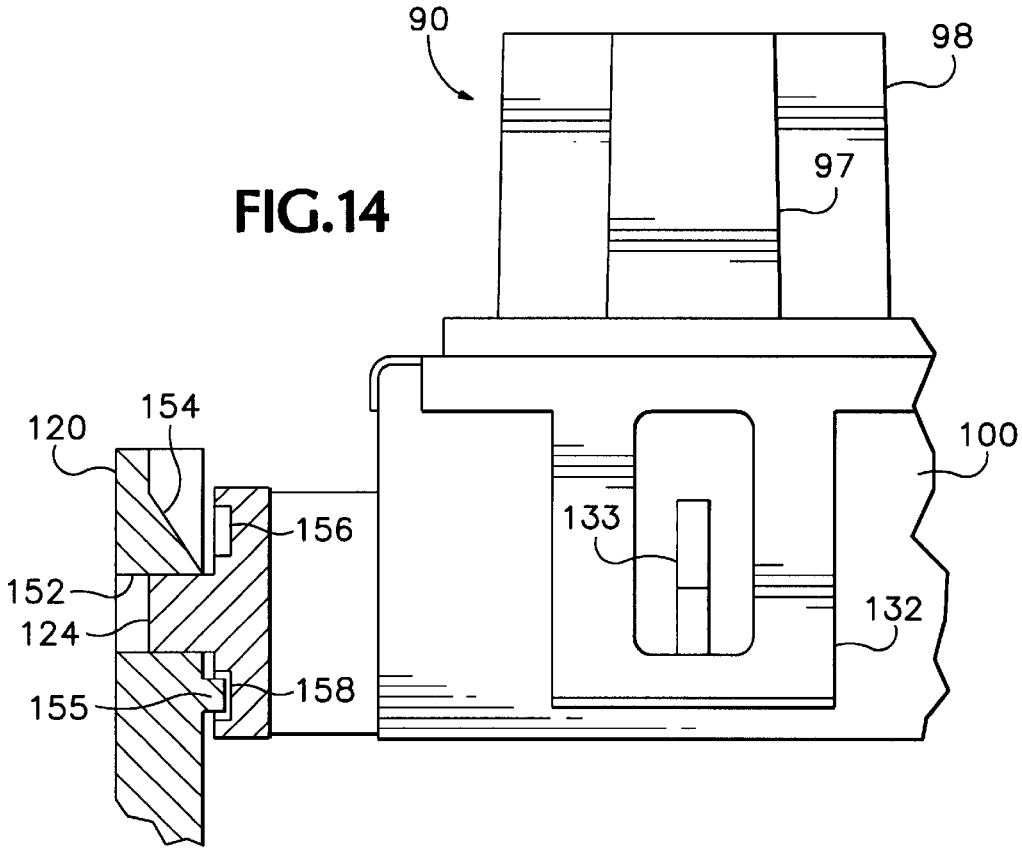
Figure 15:
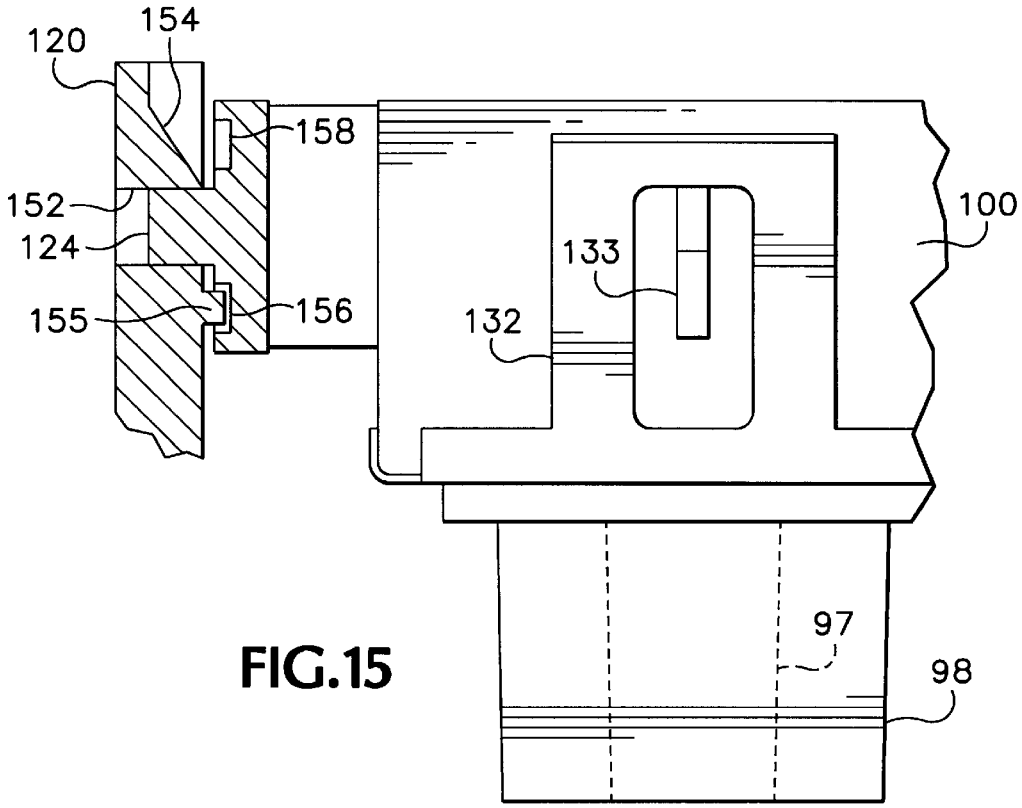

FIGS. 14 and 15 illustrate one manner of securing the sled 100 in the upright wiping position and in the inverted scraping position. One end of the sled pivot shaft 124 is shown riding within a bushing member 152 defined by pallet 120. The bushing portion 152 includes a guide ramp 154 which is used during assembly to flex this portion of the pallet outwardly as the sled is snapped into place. The opposite end of the sled 100 may be assembled to the pallet 120 in a similar fashion. The pallet 120 has a projection or detent member 155 which fits into either one of two slots 156 or 158 formed within the sled 100. As shown in FIG. 14, to secure the wiper blades in the upright wiping position, the detent 155 is engaged with slot 158. The wiper blades 97, 98 are held in the inverted scraping position through engagement of detent 155 with slot 156, as shown in FIG. 15. Understanding now how the sled 100 is held in both the upright and inverted positions, it will be better appreciated the necessity of providing the backup cam surfaces 145 and 151 to force sled 100 into the upright position so projection 155 can fully engage slot 158.

FIGS. 16–19 illustrate one form of a bristled wiper scraper cleaning system 160, constructed in accordance with the present invention for cleaning ink residue from the wiper blades 97, 98. For the purposes of illustration, one of the color wiper assemblies 106 is shown as being illustrative of the remaining wiper assemblies 100–104. In cleaning system 160, two reservoirs 162 and 164 are formed within a lower portion of the service station frame 82 surrounding the scraper assembly 118. The reservoirs 162 and 164 are each filled with an ink solvent 165, which is preferably of the same solution as applied by applicators 102–106 to the respective wiper assemblies 90–96 to clean the printheads 70–76.

While the illustrated embodiment shows two separate reservoirs 162 and 164 it is apparent that in some implementations these reservoirs may be joined into a single reservoir. Alternatively, while each of the reservoirs 162, 164 may run along the entire length of the scraper assembly 118, in some implementations it may be preferable to include additional reservoirs. For instance, it may be desirable to have a separate pair of reservoirs 162, 164 for each of the scraper bars 110–116. Alternatively, when using a dye based color ink set, and a pigment based black ink, it may be preferable to include a single pair of reservoirs 162, 164 which extend adjacent to the color scraper bars 112–116, and a second pair of reservoirs (not shown) adjacent the black scraper bar 110.

The scraper cleaning system 160 has a pair of scraper cleaning wheels 166 and 168, which clean the respective rearward and forward facing surfaces of scraper bar 116 in the illustrated embodiment. While the scraper cleaning wheels 166, 168 may extend across the width of the scraper assembly 118, it is preferable to have a dedicated set of cleaning wheels 166, 168 for each of the scraper bars 110–116, to isolate the scraper bars from cross-contamination with adjacent ink colors. In such an implementation, each pair of dedicated scraper cleaning wheels 166, 168 would be used for cleaning an associated one of the scraper bars 110–116, and each pair of cleaning wheels may be constructed as described herein for cleaning the color scraper bar 116.

Figure 16:
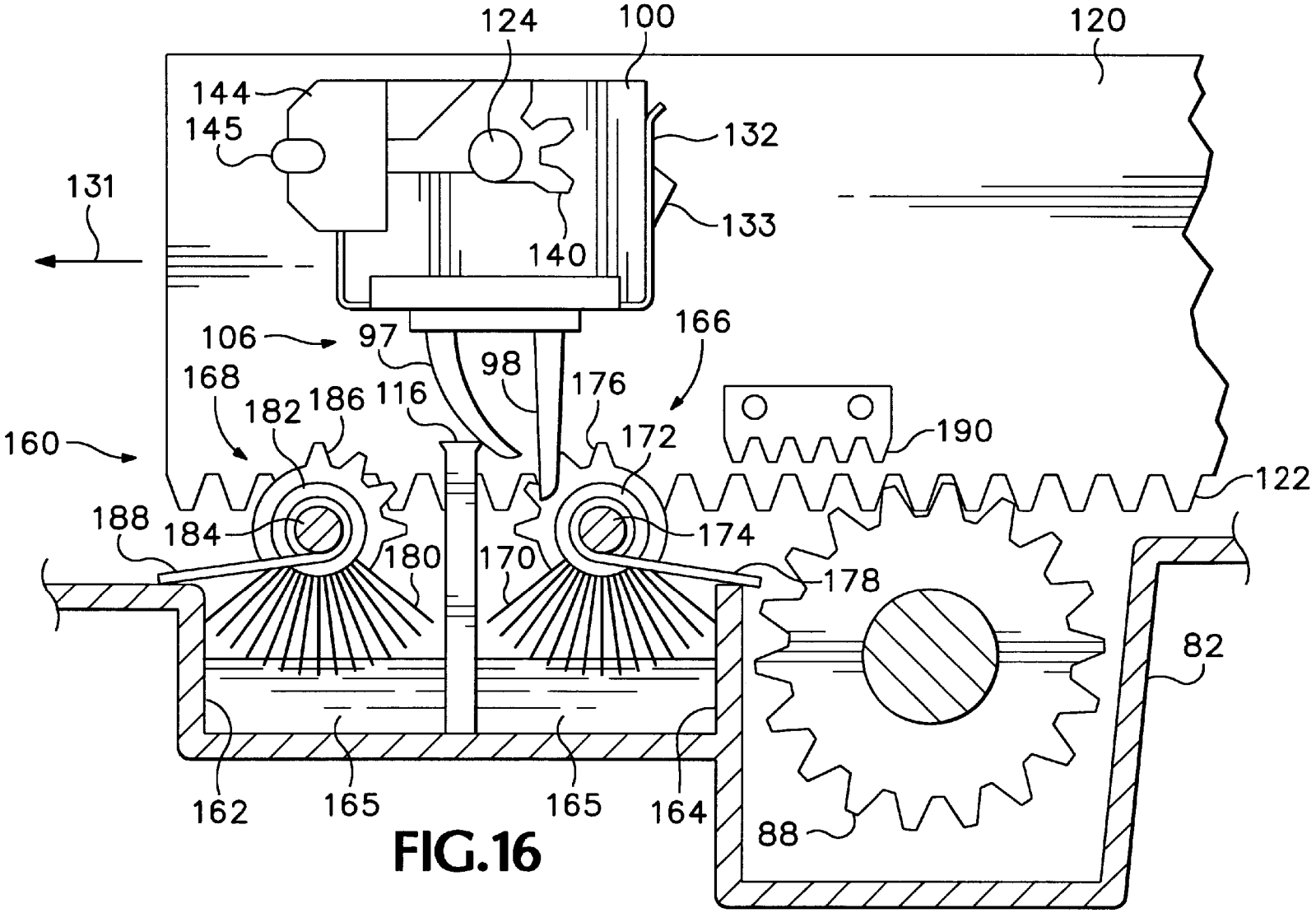
FIG. 16 is a side elevational view of one form of a bristled wiper scraper cleaning system of the present invention, shown during a first stage of scraping the wipers.

The rear scraper cleaning wheel 166 has a group of cleaning members, such as brush bristles 170 which project outwardly from a body portion 172. The body portion 172 is supported by an axle or shaft member 174, which is preferably pivotally mounted to a portion of the service station frame 82, using conventional bushing or bearing members (not shown). Also projecting from the body 172 is a gear portion 176 which only encircles a portion of the shaft 174. To bias the cleaning wheel 166 in a neutral position, as shown in FIG. 16, a biasing member, such as a torsional spring 178 may be attached to the shaft 174. The torsional spring 178 has one end which extends to engage a portion of the service station frame 82.

The front scraper cleaning wheel 168 also has a group of cleaning members, such as brush bristles 180 which project outwardly from a body portion 182. The body portion 182 is supported by an axle or shaft member 184, which is preferably pivotally mounted to a portion of the service station frame 82, using conventional bushing or bearing members (not shown). Also projecting from the body 182 is a gear portion 186 which only encircles a portion of the shaft 184. To bias the cleaning wheel 168 in a neutral position, as shown in FIG. 16, a biasing member, such as a torsional spring 188 may be attached to the shaft 184. The torsional spring 188 has one end which extends to engage a portion of the service station frame 82.

Figure 17:
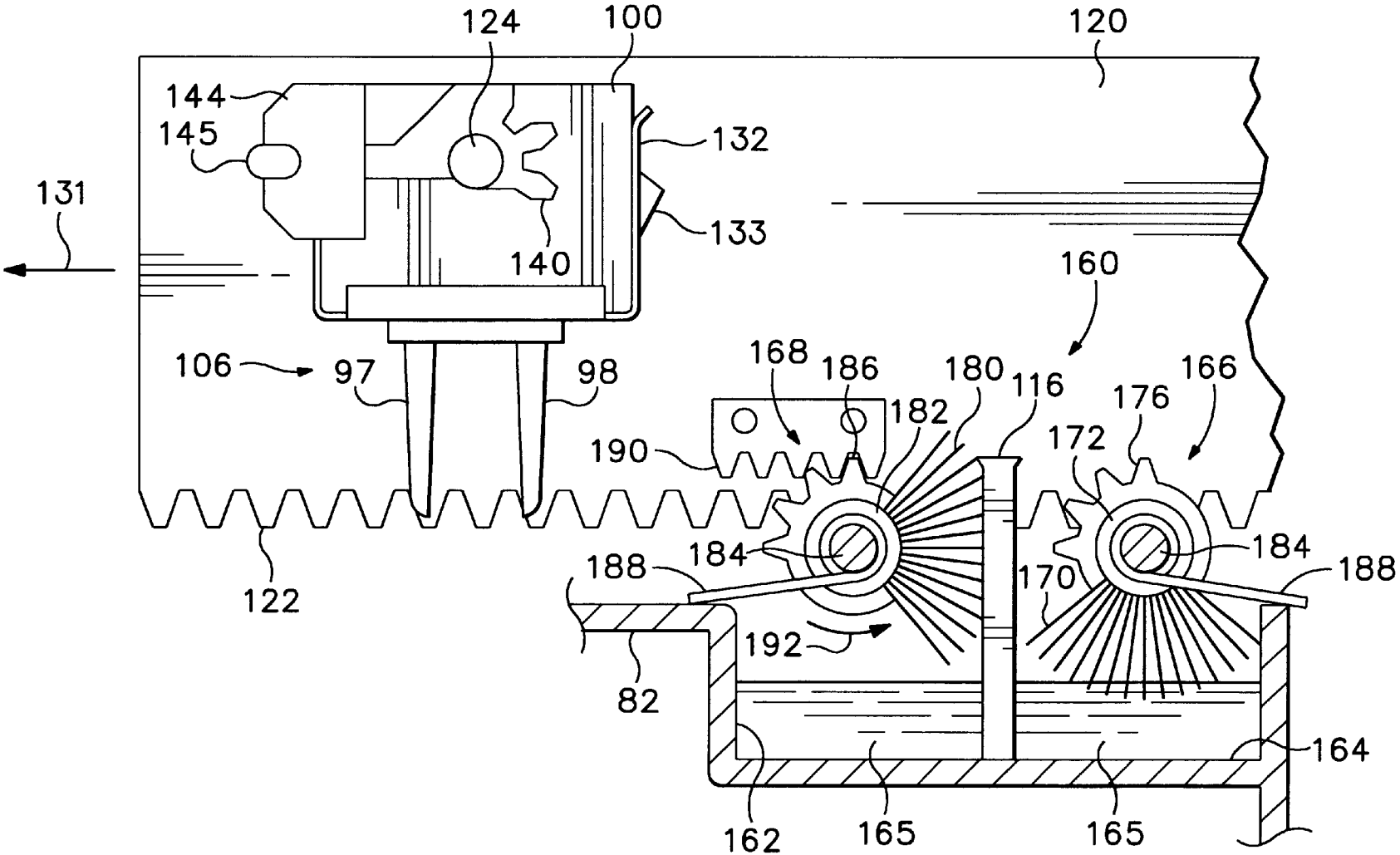
FIG. 17 is a side elevational view of the scraper cleaning system of FIG. 16, shown during a first stage of cleaning the scraper.

FIG. 16 shows a first phase of wiper cleaning, where the forward facing surfaces of wiper blades 97, 98 are scraped across the scraper bar 116 to deposit ink residue thereon. As shown in FIG. 17, after both wiper blades 97 and 98 have cleared the scraper bar 116, a rack gear 190 supported by the pallet 120 engages the gear 186 on the front cleaning wheel 168, causing it to rotate in the direction of arrow 192. The rack gear 190 is located on the pallet 120 in a location to move between or beside the scraper bars 110–116. Indeed, in one preferred embodiment a single rack gear 190 is located on the pallet 120 to pass between the middle scraper bars 112 and 114. Rotation of the cleaning wheel 168 causes the bristles 180 to pull ink solvent 165 from the reservoir 162 and use this extracted solvent to scrub the forward facing surface of scraper bar 116.

While the pallet 120 may continue to move in the forward direction of arrow 131, it is also apparent that the pallet 120 may reverse direction, and allow the bristles 180 to rotate in the direction opposite arrow 192. Through a series of forward and backward motions of the pallet 120 during engagement of gears 186 and 190, a scrubbing action ensues to clean scraper bar 116. Indeed, during such a scrubbing operation the bristles 180 may be periodically returned to the reservoir 162 to collect additional solvent 165 for scrubbing the scraper 116. Returning the bristles 180 to the reservoir 162 also allows the solvent 165 therein to clean the bristles before continuing with additional scrubbing strokes.

Figure 18:
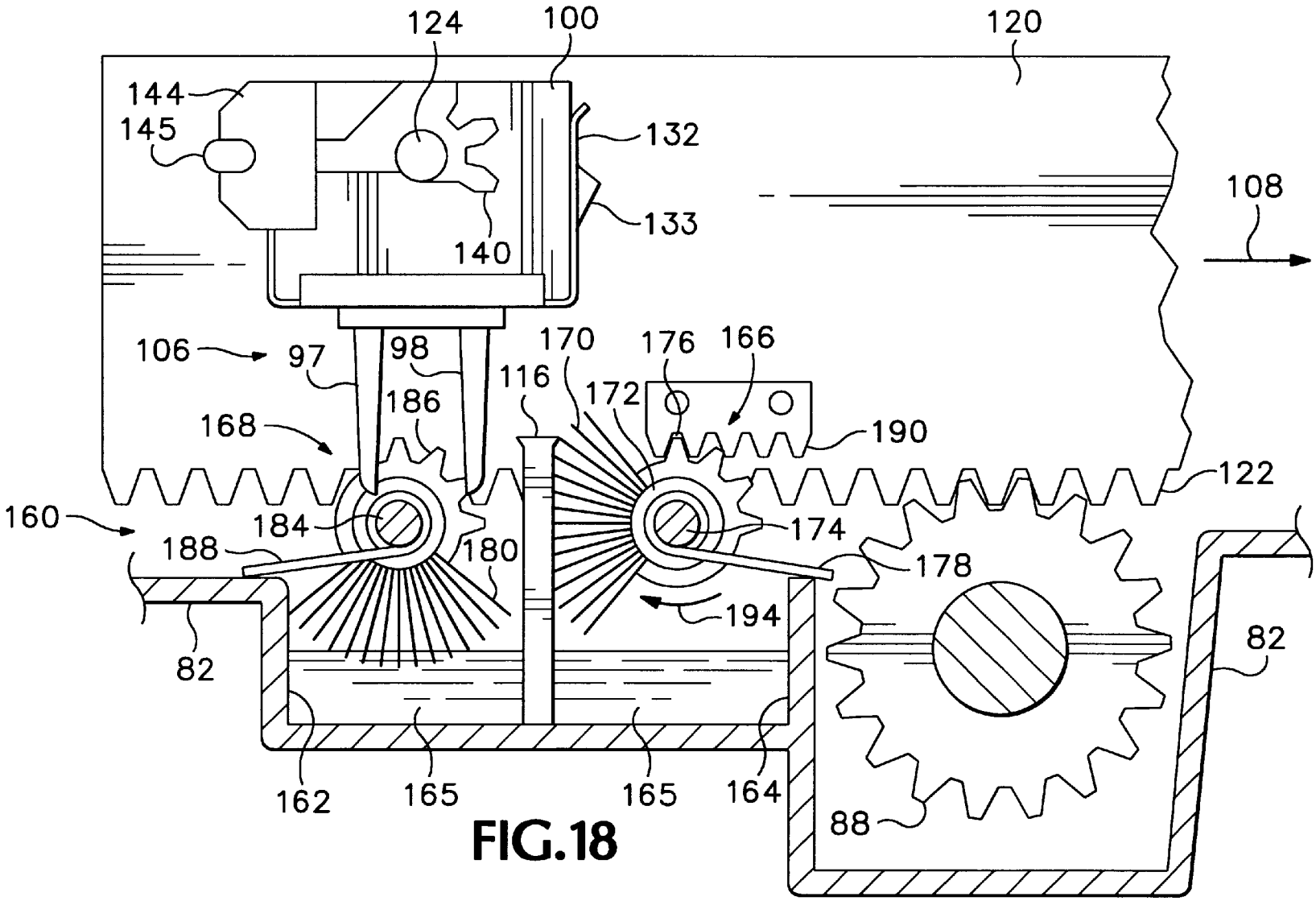
FIG. 18 is a side elevational view of the scraper system of FIG. 16, shown during a second stage of cleaning the scraper.

FIG. 18 shows the pallet 120 travelling in the rearward direction 108 so the rack gear 190 engages the wheel gear 176, causing the rear cleaning wheel 166 to rotate in the direction of arrow 194. This rotation of the scraper wheel 166 causes bristles 170 to clean the rearward facing surface of scraper bar 116, using the solvent 165 carried from the reservoir 164 by bristles 170. As described above with respect to scraper wheel 168, the pallet 120 may be moved back and forth causing gears 190 and 176 to engage and produce a scrubbing action of bristles 170 against the scraper bar 116.

Figure 19:
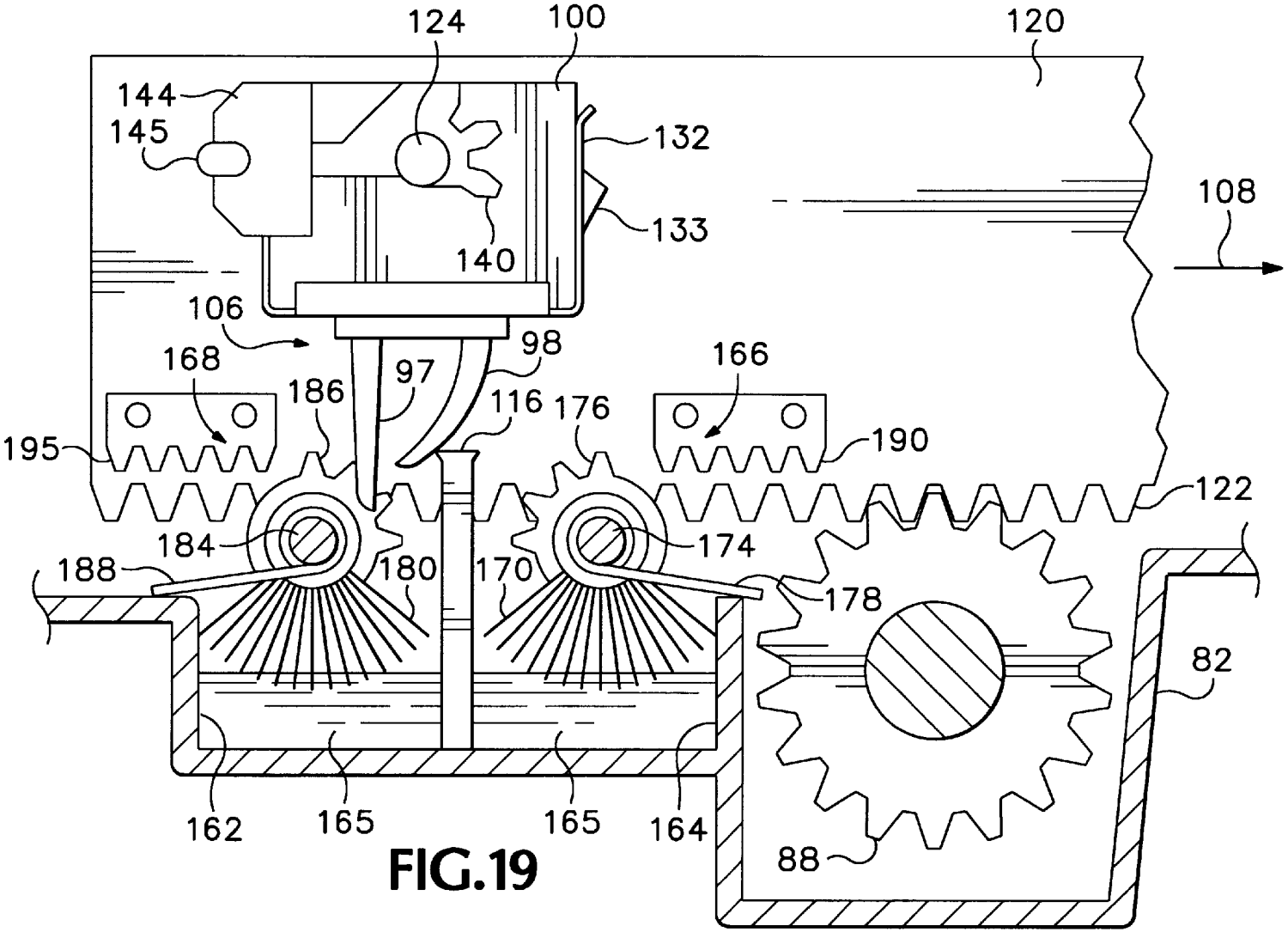
FIG. 19 is a side elevational view of the cleaning system of FIG. 16, shown during a second stage of scraping ink residue from the wipers.

FIG. 19 shows completion of the wiper cleaning stroke, where the rearward facing surfaces of wiper blades 97, 98 are cleaned by scraper bar 116 as pallet 120 moves in the rearward direction 108. The cleaning action shown in FIGS. 17 and 18 have left the scraper bar 116 clean of ink residue from the first stage of wiper scraping shown in FIG. 16. FIG. 19 also shows an alternate embodiment, where the pallet 120 may support a second rack gear 195. In this alternate embodiment, the second rack gear may be used to engage cleaning wheel gears 176 and 186 and drive the bristles 170, 180 to clean the scraper bar 116 of ink residue deposited during the second stage of the scraping stroke shown in FIG. 19. In such a case, the second rack gear 195 travels in direction 108 to first pass over cleaning wheel 168, and then engage the rear cleaning wheel 166. In a second stage of the cleaning stroke, the pallet 120 returns in the forward direction 131, passing over scraper wheel 166 to activate the front cleaning wheel 168.

Conclusion

Thus, a variety of advantages are realized using the flipping wiper scraper service station 80, and several of these advantages have been noted above. For example, use of the flipping mechanism described in FIGS. 2–15 advantageously allows the controller 40 to have complete knowledge of the mechanical state of the service station 80 through counting the steps of motor 85, without requiring extra position sensors or feedback mechanisms. Furthermore, the service station 80 only needs a single motor 85 to accomplish the servicing functions which some earlier service stations needed two or more motors to accomplish. Thus, needing fewer motors and no position sensors, the flipping service station 80 is lower in cost to manufacture than earlier service stations.

A variety of advantages are also realized using the bristled scraper cleaning system 160. For instance, by locating the bristles 170, 180 to soak in the ink solvent bath 165 when in the neutral position of FIG. 16, ink residue deposited on the bristles from previous cleaning strokes may be dissolved away. Moreover, through the capillary nature of the bristles 170, 180, ink solvent 165 may wick upwardly between adjacent bristles through capillary forces, allowing the solvent to penetrate the bristles closer to the shaft 174, 184. Thus, even as the reservoirs 162, 164 become low on solvent over time, this wicking action serves to pull the solvent 165 out of the reservoirs, so the useful life of the design is not limited only the soaking action to apply solvent to the bristles. Moreover, while the preferred embodiment uses ink solvent 165, in other implementations the solvent may be eliminated, so the cleaning action occurs merely through the physical scraping contact of the bristles 170, 180 with the scraper bar.

The inventive concepts described herein by way of the illustrated embodiments in FIGS. 1–19 maybe implemented in a variety of different ways which still fall within the scope of the claims below. For instance, while the wipers are shown being flipped from an upright primary wiping operation to a secondary scraping operation below, in some service stations, such as those having caps or primers, it may be desirable to flip either the caps or primers under the pallet for a secondary operation, such as for blotting ink residue from the interior of the caps or primers. Thus, while illustrated in terms of wipers and scrapers, the broader concept of the flipping service station 80 is to perform a primary servicing operation upon printheads 70–76, and a secondary operation on the servicing component when the pallet is flipped to the inverted position, thus readying the servicing component for the next servicing operation.

I claim:

1. A wiper scraper cleaning system for cleaning ink residue from a scraper which has removed the ink residue from a wiper following an inkjet printhead wiping routine where the wiper wiped the ink residue from the printhead in an inkjet printing mechanism, comprising:

a frame;

a moveable platform supported by the frame to move the wiper through a scraping stroke and a wiping stroke for cleaning ink residue from the printhead;

a scraper supported by the frame to scrape ink residue from the wiper during the scraping stroke; and a scraper cleaner supported by the frame for movement from a rest position through a scraper cleaning stroke to remove ink residue from the scraper.

2. A wiper scraper cleaning system according to claim 1 wherein:

the platform is supported by the frame to move through a first stroke; and the scraper cleaner moves from the rest position through the scraper cleaning stroke in response to movement of the platform through the first stroke.

3. A wiper scraper cleaning system according to claim 1 further including a biasing member which returns the scraper cleaner to the rest position following the scraper cleaning stroke.

4. A wiper scraper cleaning system according to claim 1 wherein:

the scraper has opposing first and second surfaces; and the scraper cleaner includes a first cleaning member which cleans the first surface of the scraper, and a second cleaning member which cleans the second surface of the scraper.

5. A wiper scraper cleaning system according to claim 4 wherein:

the platform is supported by the frame to move through a first stroke and a second stroke;

the first cleaning member moves from the rest position through a first portion of the scraper cleaning stroke in response to movement of the platform through the first stroke; and the second cleaning member moves from the rest position through a second portion of the scraper cleaning stroke in response to movement of the platform through the second stroke.

6. A wiper scraper cleaning system according to claim 5 wherein:

the platform has a drive gear;

the first cleaning member has a first gear which is engaged by the platform drive gear as the platform moves through the first stroke; and the second cleaning member has a second gear which is engaged by the platform drive gear as the platform moves through the second stroke.

7. A wiper scraper cleaning system according to claim 4 wherein:

the first cleaning member has a brush portion with bristles which scrub the first surface of the scraper as the platform moves through the first stroke; and the second cleaning member has another brush portion with bristles which scrub the second surface of the scraper as the platform moves through the second stroke.

8. A wiper scraper cleaning system according to claim 1 further including:

a reservoir supported by the frame; and an ink solvent contained within the reservoir;

wherein the reservoir is supported by the frame to soak a portion of the scraper cleaner when in the rest position.

9. A wiper scraper cleaning system according to claim 1 wherein:

the scraper has opposing first and second surfaces;

the scraper cleaner includes a first cleaning member which cleans the first surface of the scraper, and a second cleaning member which cleans the second surface of the scraper;

the platform is supported by the frame to move through a first stroke and a second stroke, with the platform having a drive gear;

the first cleaning member has a first gear which is engaged by the platform drive gear as the platform moves through the first stroke, with the first cleaning member having a brush portion with bristles which scrub the first surface of the scraper as the platform moves through the first stroke; and the second cleaning member has a second gear which is engaged by the platform drive gear as the platform moves through the second stroke, with the second cleaning member having another brush portion with bristles which scrub the second surface of the scraper as the platform moves through the second stroke;

the wiper scraper cleaning system further includes a reservoir supported by the frame, and an ink solvent contained within the reservoir to soak said brush portions of the first and second cleaning members when scraper cleaner is in the rest position.

10. An inkjet printing mechanism, comprising:

a frame;

an inkjet printhead supported by the frame for printing in a printzone and for servicing in a servicing region;

a wiper;

a moveable platform supported by the frame to move the wiper through a scraping stroke and a wiping stroke for cleaning ink residue from the printhead when in the servicing region;

a scraper supported by the frame to scrape ink residue from the wiper during the scraping stroke; and a scraper cleaner supported by the frame for movement from a rest position through a scraper cleaning stroke to remove ink residue from the scraper.

11. An inkjet printing mechanism according to claim 10 wherein:

the platform is supported by the frame to move through a first stroke; and the scraper cleaner moves from the rest position through the scraper cleaning stroke in response to movement of the platform through the first stroke.

12. An inkjet printing mechanism according to claim 10 wherein:

the scraper has opposing first and second surfaces; and the scraper cleaner includes a first cleaning member which cleans the first surface of the scraper, and a second cleaning member which cleans the second surface of the scraper.

13. An inkjet printing mechanism according to claim 12 wherein:

the first cleaning member has a brush portion with bristles which scrub the first surface of the scraper as the platform moves through the first stroke; and the second cleaning member has another brush portion with bristles which scrub the second surface of the scraper as the platform moves through the second stroke.

14. An inkjet printing mechanism according to claim 10 further including:

a reservoir supported by the frame; and an ink solvent contained within the reservoir;

wherein the reservoir is supported by the frame to soak a portion of the scraper cleaner when in the rest position.

15. A method of cleaning ink residue from an inkjet printhead in an inkjet printing mechanism, comprising the steps of:

providing a wiper, a scraper, and a scraper cleaner;

wiping ink residue from the printhead using the wiper;

scraping ink residue from the wiper; and following the scraping step, cleaning the scraper with the scraper cleaner.

16. A method according to claim 15 wherein:

the providing step further comprises providing a bath of ink solvent; and the method further includes the step of, following the cleaning step, soaking a portion of the scraper cleaner in the ink solvent bath.

17. A method according to claim 15 wherein:

the wiping step comprises wiping the printhead with the wiper in a wiping orientation;

the scraping step comprises scraping the wiper with the wiper in an inverted orientation opposite the wiping orientation; and the method further includes the step of, between the wiping step and the scraping step, inverting the wiper between the wiping orientation and the scraping orientation.

18. A method according to claim 15 wherein:

the providing step further comprises providing a platform which supports the wiper, and providing the scraper cleaner as a moveable cleaning member; and the cleaning step comprises moving the cleaning member with the platform.

19. A method according to claim 18 wherein the moving step comprises the step of rotating the cleaning member.

20. A method according to claim 18 wherein:

the providing step further comprises providing the scraper cleaner as a pair of moveable cleaning members; and the cleaning step comprises cleaning two opposing surfaces of the scraper by sandwiching the scraper between the pair of cleaning members.

* * * * *